US007223209B2

(12) United States Patent
Lee

(10) Patent No.: US 7,223,209 B2
(45) Date of Patent: May 29, 2007

(54) ELLIPTICAL EXERCISE APPARATUS

(76) Inventor: Lung-Huei Lee, No. 1, Lane 1561, Sec. 1, Chung-Shan Rd., Ta-Chia Chen, Taichung Hsien (TW)

( * ) Notice: Subject to any disclaimer, the term of this patent is extended or adjusted under 35 U.S.C. 154(b) by 77 days.

(21) Appl. No.: 11/264,872

(22) Filed: Nov. 2, 2005

(65) Prior Publication Data

US 2007/0054779 A1 Mar. 8, 2007

(51) Int. Cl.
*A63B 69/66* (2006.01)
*A63B 22/04* (2006.01)

(52) U.S. Cl. ..... 482/52; 482/70; 482/57

(58) Field of Classification Search ..... 482/51, 482/52, 57, 70, 79–80
See application file for complete search history.

(56) References Cited

U.S. PATENT DOCUMENTS 5,685,804 A * 11/1997 Whan-Tong et al. ..... 482/51
6,007,462 A * 12/1999 Chen ..... 482/57
6,042,512 A * 3/2000 Eschenbach ..... 482/52
6,454,682 B1 9/2002 Kuo ..... 482/52
6,835,166 B1 * 12/2004 Stearns et al. ..... 482/52
7,060,004 B2 * 6/2006 Kuo ..... 482/52
7,097,591 B2 * 8/2006 Moon ..... 482/52

* cited by examiner

*Primary Examiner*—Stephen R. Crow
(74) *Attorney, Agent, or Firm*—Girard & Equitz LLP

(57) ABSTRACT

An elliptical exercise apparatus includes an upstanding support connected to a front end of a base support, a rail assembly provided on a rear end of the base support, a wheel assembly mounted on the front end of the base support, a swing rod connected pivotally to the upstanding support, a slide rod having a rear end slidable forwardly and rearwardly along the rail assembly and a front end connected pivotally to the wheel assembly, a pedal seat connected pivotally to the slide rod, a pedal member mounted slidably on the pedal seat, a first link rod having a front end connected pivotally to the swing rod and a rear end connected pivotally to the pedal seat, and a second link rod having a front end connected pivotally to the swing rod below the first link rod and a rear end fixed to the pedal member.

4 Claims, 9 Drawing Sheets

ELLIPTICAL EXERCISE APPARATUS

BACKGROUND OF THE INVENTION

1. Field of the Invention

The invention relates to exercise equipment, more particularly to an elliptical exercise apparatus.

2. Description of the Related Art

FIGS. 1 to 3 illustrate a conventional elliptical exercise apparatus 1 which was disclosed in Taiwanese Utility Model Publication No. 414094 and which was invented by the applicant in February, 2000. The elliptical exercise apparatus 1 comprises a main frame 11, two swing units 113, a wheel assembly 12, two tubular sleeves 13, two slide rods 14, two link rods 15, and two pedal members 151. The main frame 11 includes an upstanding support 111, and a base support 112 connected to the upstanding support 111. The base support 112 has a rear end provided with two parallel guide rails 114.

The swing units 113 are connected pivotally and respectively to two opposite sides of the upstanding support 111.

The wheel assembly 12 is disposed on a front side of the main frame 11, and includes a resistance wheel 121, a crank wheel 122, and two crank members 123 connected respectively to two opposite ends of a crankshaft of the crank wheel 122. The resistance wheel 121 is connected to the crank wheel 122 through a belt or a magnetic mechanism so as to provide resistance to rotation of the crank wheel 122.

The tubular sleeves 13 are sleeved slidably and respectively on bottom portions of the swing units 113. Each tubular sleeve 13 includes spaced-apart universal upper and lower connectors 131, 132 connected to a rear side of the corresponding tubular sleeve 13. The upper connector 131 is connected pivotally to a corresponding one of the crank members 123.

Each slide rod 14 includes a front section 144 having a front end connected pivotally to the corresponding crank member 123, an intermediate section extending rearwardly from a rear end of the front section 144 and secured with a pedal seat 141, and a rear section 142 extending rearwardly, curvedly, and downwardly from a rear end of the intermediate section and having a rear end provided with a roller 143 that is slidable forwardly and rearwardly along the corresponding guide rail 114.

Each link rod 15 has a front end connected pivotally to the lower connector 132, and a rear end connected pivotally to the pedal seat 141.

The pedal members 151 are mounted slidably and respectively on the pedal seats 141 of the slide rods 14.

With reference to FIGS. 2 and 3, when the user steps on the pedal members 151 and starts exercising by exerting a force on the pedal members 151 in an alternating manner, the front end of the front section 144 of each slide rod 14 moves along with the corresponding crank member 123 in a circular motion, and the rear end of the rear section 142 of each slide rod 14 moves forward and rearward along the respective guide rail 114 through the slidable engagement of the roller 143 with the respective guide rail 114. As a consequence, the user's feet travel in a generally elliptical track shown in FIG. 3. Simultaneously, each tubular sleeve 13 moves with the corresponding crank member 123 so as to cause the bottom portion of each swing unit 113 to swing reciprocally, thereby effecting exercise of the user's upper body when the user's hands grasp upper portions of the swing units 113.

Although the conventional elliptical exercise apparatus 1 can achieve its intended purpose, it produces an elliptical track that is long in a front-to-rear direction and narrow in a top-to-bottom direction. Hence, there are sharp turns at front and rear ends of the track such that the elliptical motion of the user's feet is not smooth.

SUMMARY OF THE INVENTION

Therefore, the object of the present invention is to provide an elliptical exercise apparatus that is capable of overcoming the aforementioned drawback of the prior art.

According to this invention, an elliptical exercise apparatus comprises a main frame, a wheel assembly, a swing rod, a slide rod, a pedal seat, a pedal member, a first link rod, and a second link rod. The main frame includes a base support adapted to be supported on a supporting surface and having front and rear ends, an upstanding support connected to the front end of the base support, and a rail assembly provided on the rear end of the base support. The wheel assembly is mounted on the front end of the base support, and includes a crank member. The swing rod is connected pivotally to the upstanding support, and has a bottom section. The slide rod has a rear end slidable forwardly and rearwardly along the rail assembly, and a front end connected pivotally to the crank member. The pedal seat is connected pivotally to the slide rod. The pedal member is mounted slidably on the pedal seat. The first link rod has a front end connected pivotally to the bottom section of the swing rod, and a rear end connected pivotally to the pedal seat. The second link rod has a front end connected pivotally to the bottom section of the swing rod below the front end of the first link rod, and a rear end fixed to the pedal member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
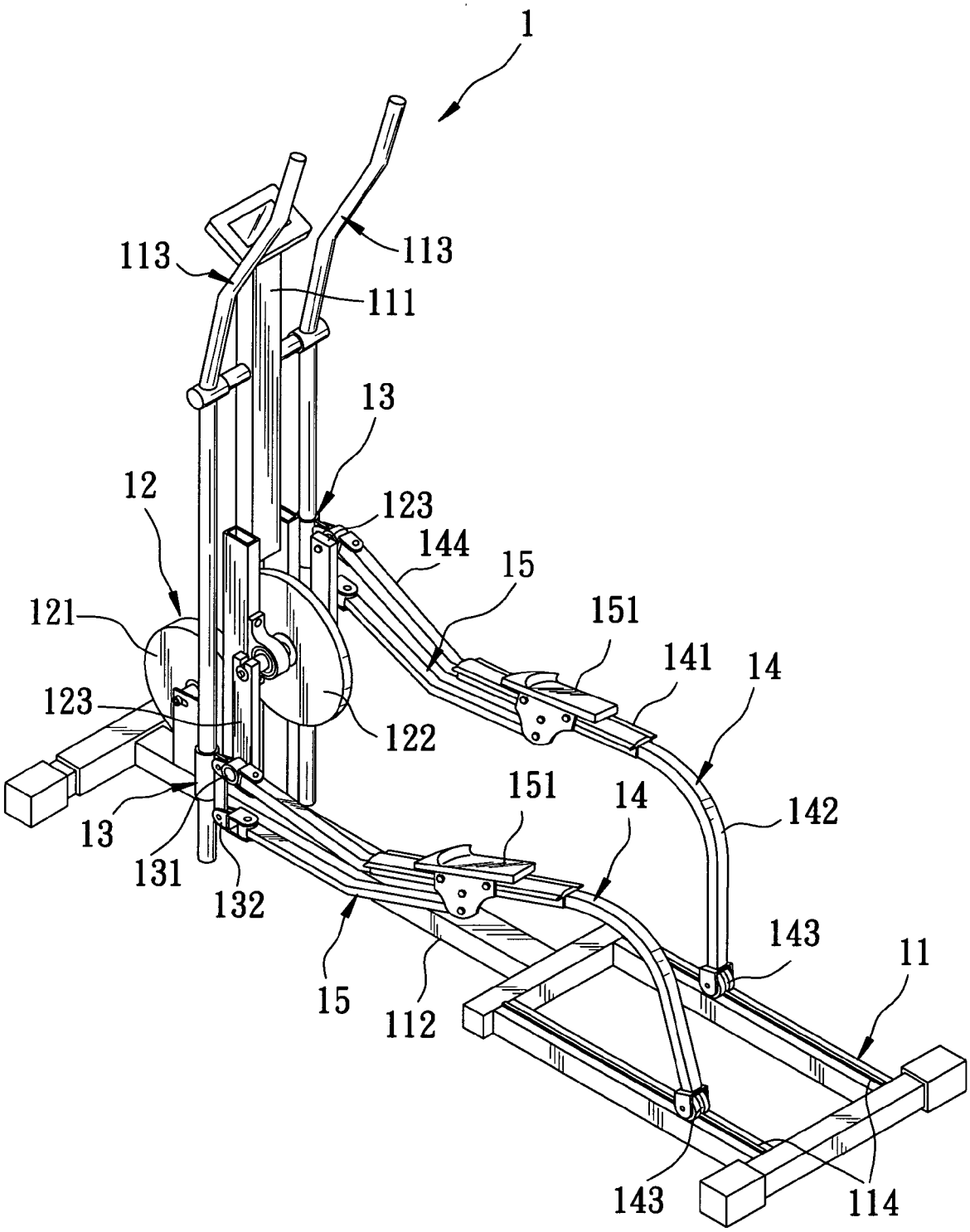
FIG. 1 PRIOR ART
FIG. 1 is a perspective view of a conventional elliptical exercise apparatus disclosed in Taiwanese Utility Model Publication No. 414094.
Figure 2:
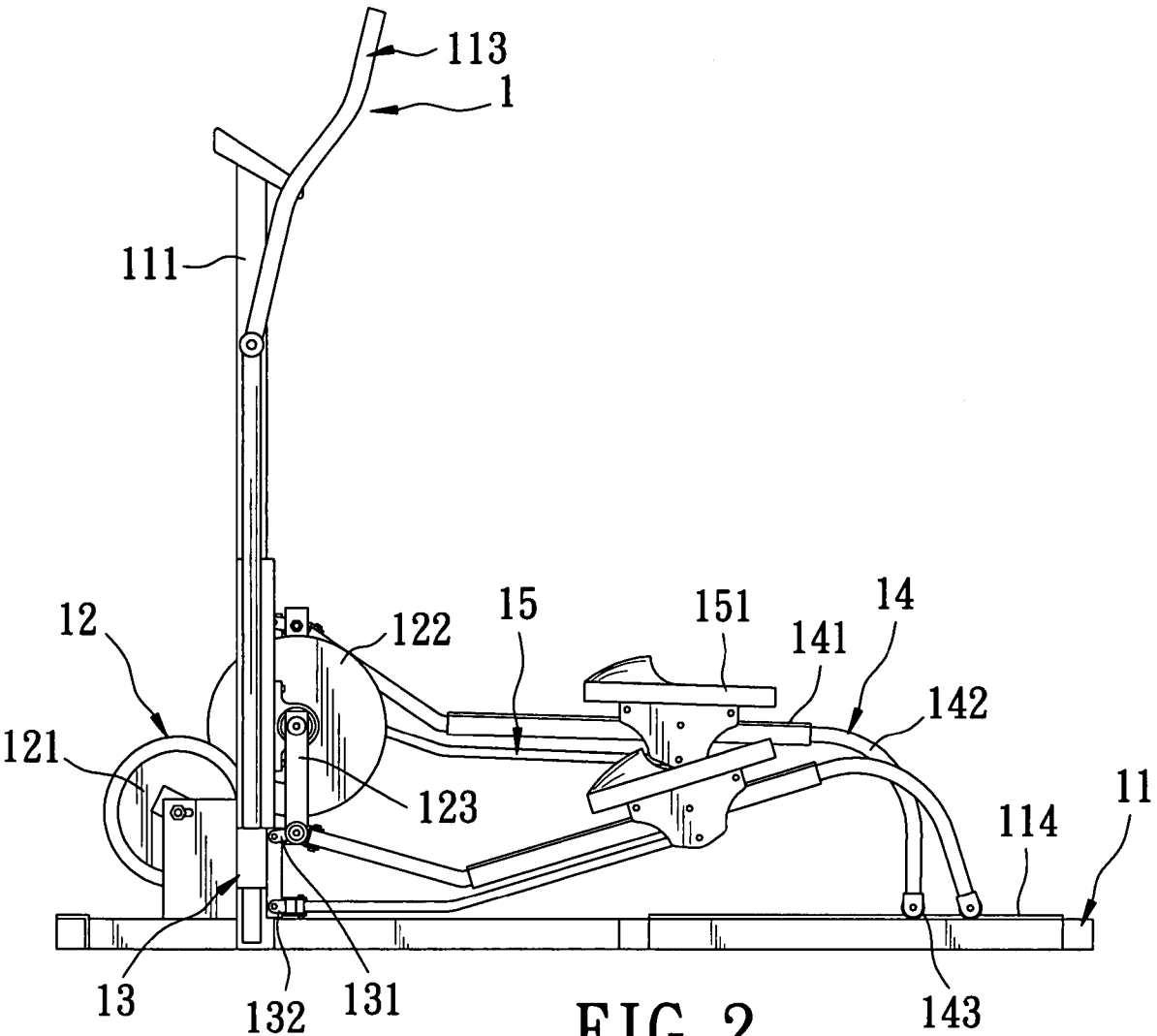
FIG. 2 PRIOR ART
FIG. 2 is a schematic side view of the elliptical exercise apparatus of FIG. 1.
Figure 3:
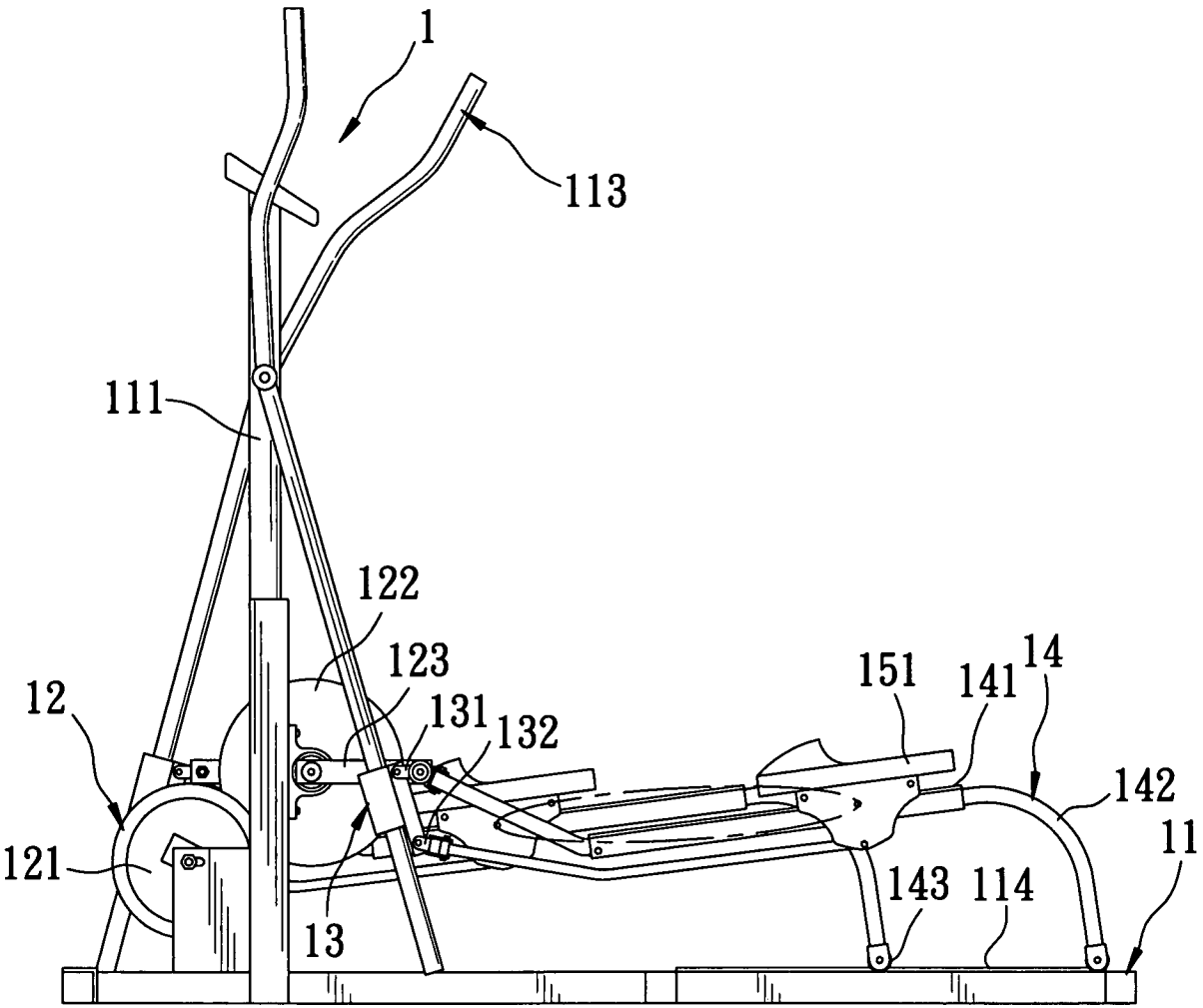
FIG. 3 PRIOR ART
FIG. 3 is a view similar to FIG. 2, but illustrating an elliptical track produced by the elliptical exercise apparatus of FIG. 1.
Figure 4:
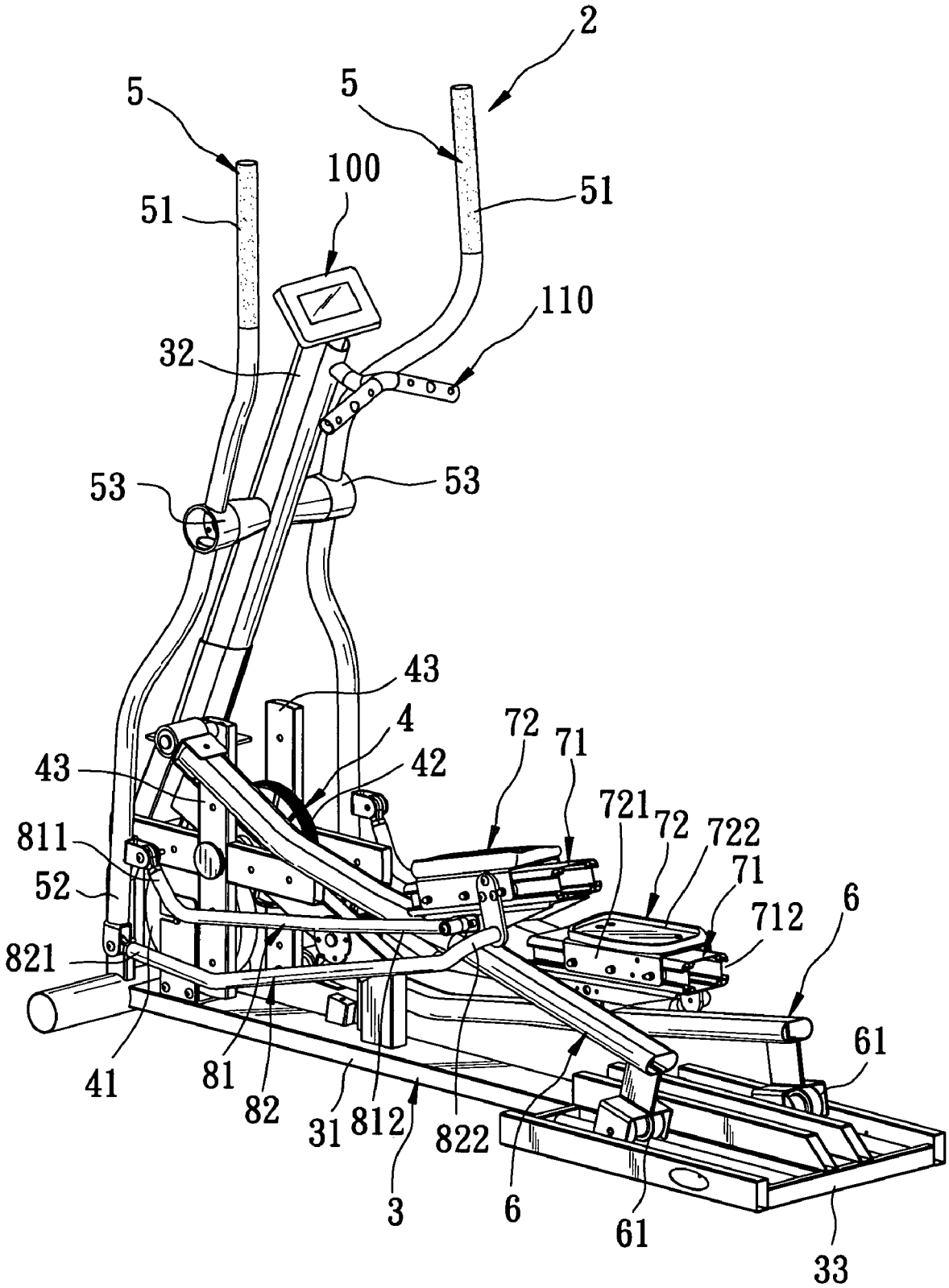
FIG. 4 is a perspective view of the preferred embodiment of an elliptical exercise apparatus according to the present invention.
Figure 5:
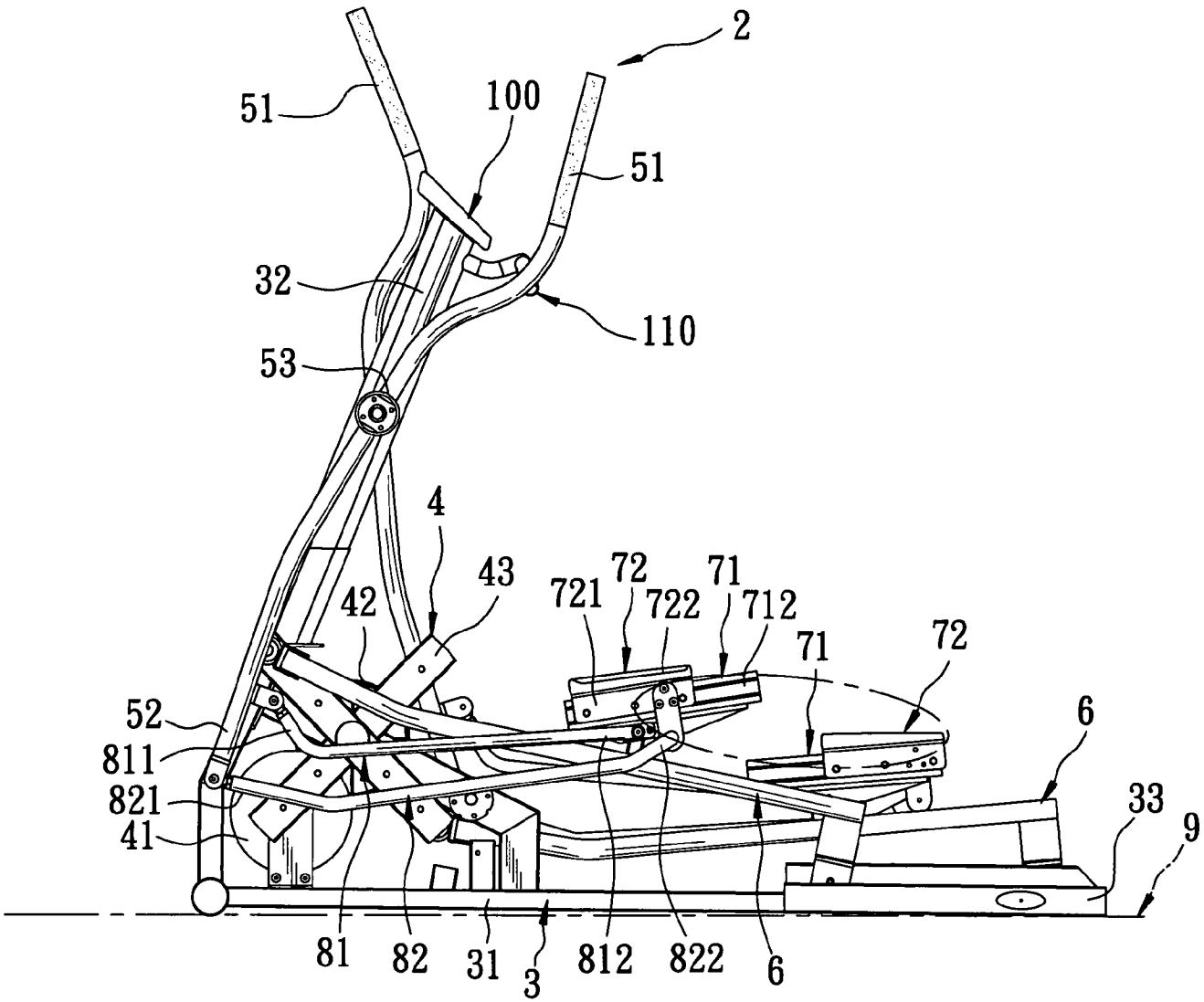
FIG. 5 is a schematic side view of the elliptical exercise apparatus of FIG. 4.

Referring to FIGS. 4 to 7, the preferred embodiment of an elliptical exercise apparatus 2 according to the present invention is shown to comprise a main frame 3, a wheel assembly 4, two swing rods 5, two slide rods 6, two pedal seats 71, two pedal members 72, two first link rods 81, and two second link rods 82.

The main frame 3 includes a base support 31 adapted to be mounted on a supporting surface 9 (see FIG. 5), an upstanding support 32 connected to a front end of the base support 31, and a rail assembly 33 connected to a rear end of the base support 31. Since the rail assembly 33 is known in the art, a detailed description of the same is dispensed herein for the sake of brevity.

The wheel assembly 4 is mounted on the front end of the base support 31 rearwardly of the upstanding support 32, and includes a resistance wheel 41, a crank wheel 42, and two crank members 43 connected respectively to two opposite ends of a crankshaft of the crank wheel 42. The resistance wheel 41 is connected to the crank wheel 42 in a conventional manner so as to provide resistance to rotation of the crank wheel 42.

The swing rods 5 are connected pivotally and respectively to left and right sides of the upstanding support 32. Each swing rod 5 includes a grip section 51, a bottom section 52 extending downwardly from the grip section 51, and a pivot section 53 between the grip section 51 and the bottom section 52 and connected pivotally to a corresponding left or right side of the upstanding support 32.

Each slide rod 6 has a front end connected pivotally to the corresponding crank member 43, and a rear end provided with a roller unit 61 that is slidable forwardly and rearwardly along the rail assembly 33.

Figure 7:
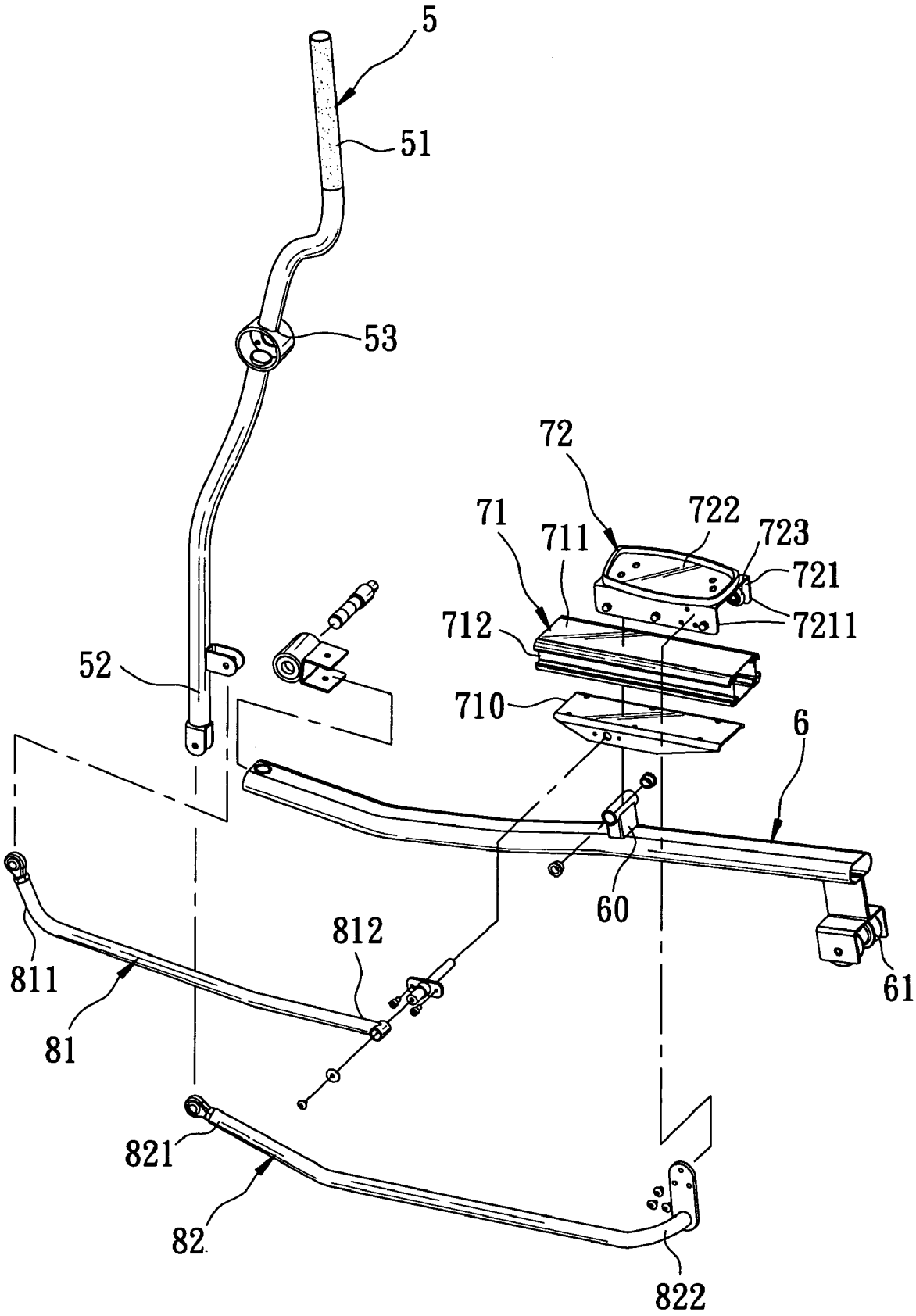
FIG. 7 is an exploded perspective view of the components shown in FIG. 6.

Each pedal seat 71, as best shown in FIG. 7, includes a pedal support 710 connected pivotally to a fulcrum 60 of the corresponding slide rod 6, and a pedal rail 711 fixed to the pedal support 710 and having two opposite lateral sides formed respectively with slide grooves 712.

Figure 6:
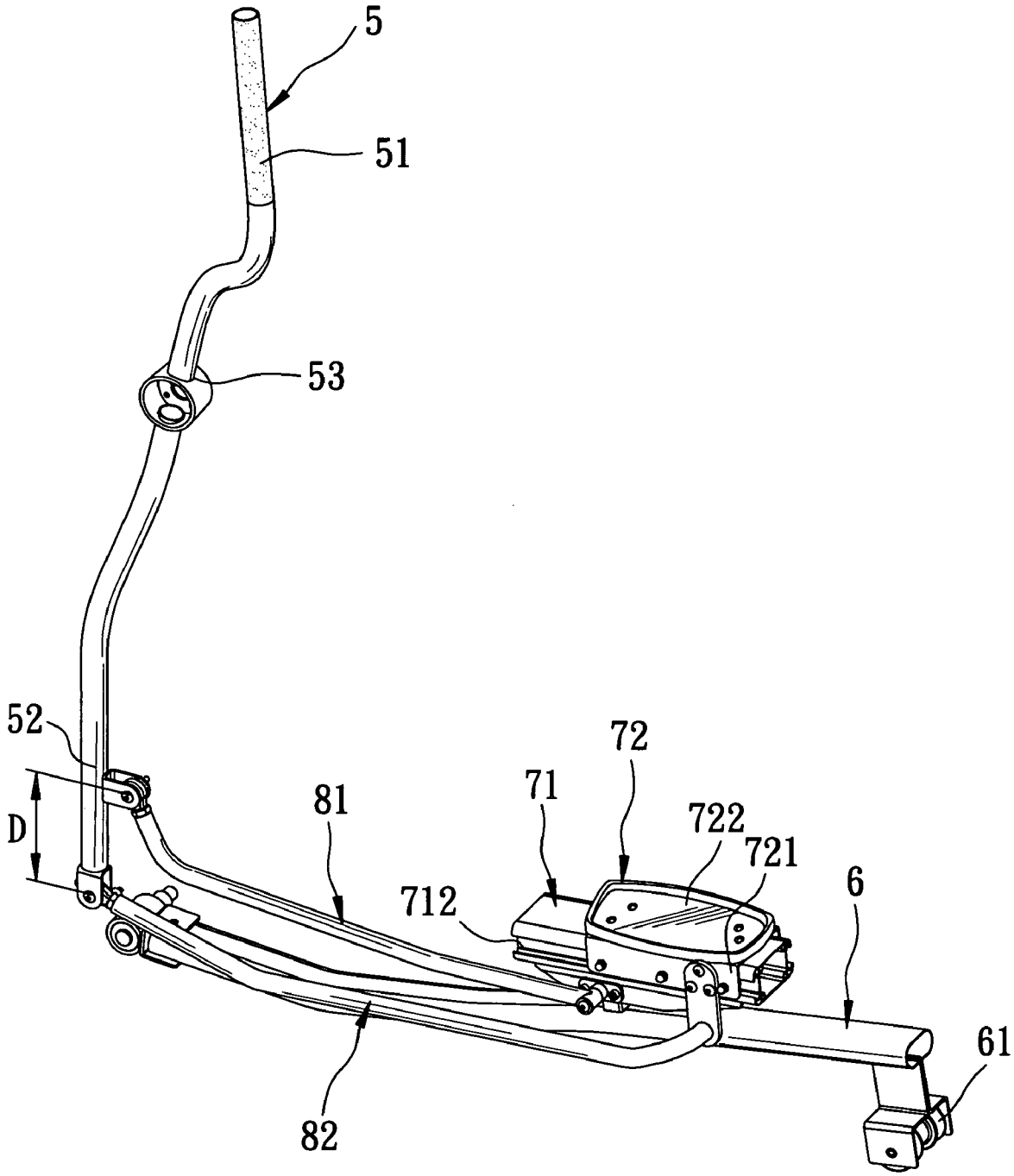
FIG. 6 is a perspective view, showing one swing rod, one pedal seat, one pedal member, one first link rod, and one second link rod.

Each pedal member 72, as best shown in FIGS. 6 and 7, is mounted slidably on the respective pedal seat 71, and includes an inverted U-shaped slide plate 721 having two opposite side plates 7211, a pedal plate 722 fixed on top of the slide plate 721, and a plurality of rollers 723 (only one is visible in FIG. 7) mounted respectively on inner faces of the side plates 7211 and received slidably and correspondingly in the slide grooves 712 in the pedal rail 711 so that the pedal member 72 can slide forwardly, rearwardly, and smoothly along the pedal seat 71.

Each first link rod 81 has a front end 811 connected pivotally to the bottom section 52 of the corresponding swing rod 5, and a rear end 812 connected pivotally to a lateral side of the pedal support 710 of the corresponding pedal seat 71. The second link rod 82 has a front end 821 connected pivotally to a bottom end of the bottom section 52 of the corresponding swing rod 5, and a rear end 822 fixed to one of the side plates 721 of the corresponding pedal member 72. The front end 811 of the first link rod 81 is located above the front end 821 of the second link rod 82, and is spaced apart from the same at a distance (D), as indicated in FIG. 6.

The elliptical exercise apparatus 2 of the present invention further comprises a console panel 100 mounted on a top end of the upstanding support 32, and a handle unit 110 fixed to a top portion of the upstanding support 32 below the console panel 100. The console panel 100 is a computerized device for controlling the operating parameters of the exercise apparatus 2, including the amount of resistance provided by the resistance wheel 41 to the rotation of the crank wheel 42. The handle unit 110 may be grasped by the user if it is desired to exercise only the lower body, and may include sensors (not shown) to detect the pulse rate of the user. Since the console panel 100 and the handle unit 110 are known in the art, a detailed description of the same is dispensed herein for the sake of brevity.

Figure 8:
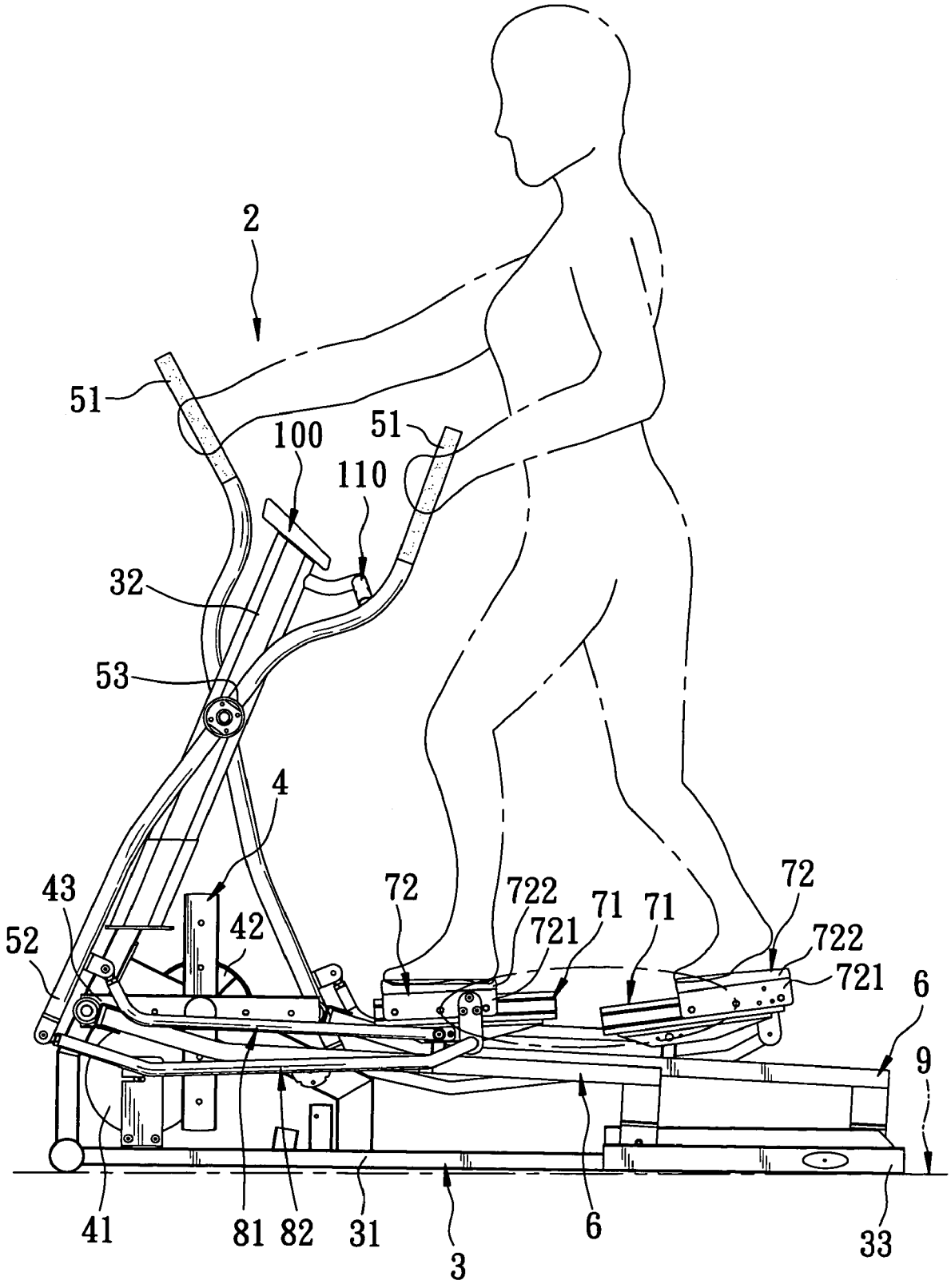
FIGS. 8 and 9 illustrate the elliptical exercise apparatus of the present invention in a state of use.
Figure 9:
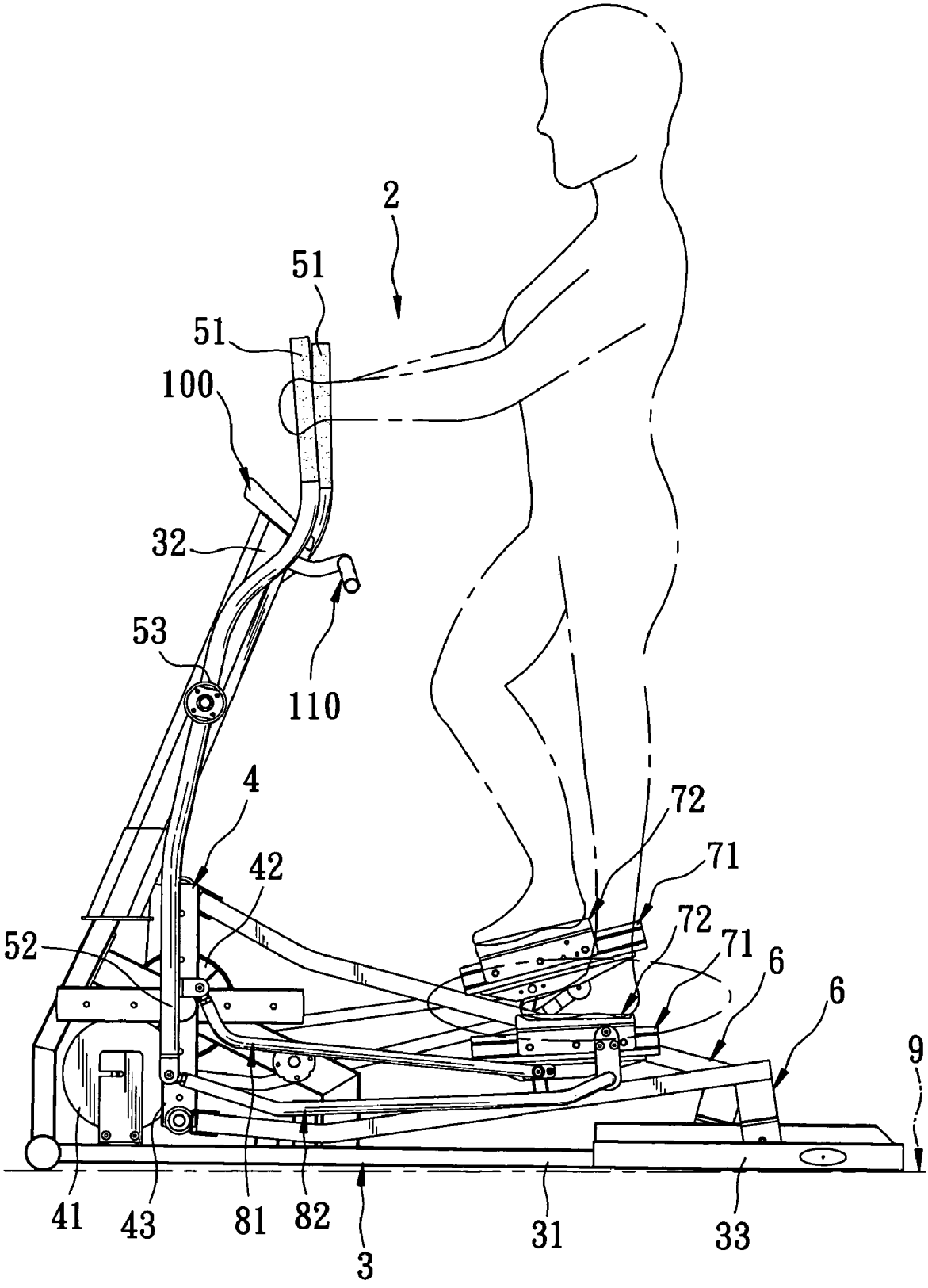

FIGS. 8 and 9 illustrate continuous stepping actions of the user during exercise. When the user stands on the pedal members 72 with her hands grasping the grip sections 51 of the swing rods 5, and exerts a force on the pedal members 72 in an alternating manner, the slide rods 6, the link rods 81, 82, and the wheel assembly 4 move by virtue of the interconnections described above. Continuous movement of these components results in the user's feet traveling along an elliptical track. The elliptical track produced by the elliptical exercise apparatus 2 of the present invention has front and rear ends that are rounded, as best shown in FIGS. 8 and 9, so that the elliptical motion of the user's feet is smooth.

Further, because the pedal members 72 can pivot downward or upward in an inclined manner during the forward and rearward movement of the pedal members 72 so as to simulate a striding movement, strain on the user's knees can be reduced. For this reason and that of the user's feet traveling along a large elliptical track, the elliptical exercise apparatus 2 of the present invention is ergonomically advantageous to the user.

During manufacture, the distance (D) between the front ends 811, 821 of the first and second link rods 81, 82, as well as the length of the pedal seats 71 may be increased so that a larger elliptical track can be obtained during exercise.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An elliptical exercise apparatus comprising:

a main frame including a base support adapted to be supported on a supporting surface and having front and rear ends, an upstanding support connected to said front end of said base support, and a rail assembly provided on said rear end of said base support;

a wheel assembly mounted on said front end of said base support, and including a crank member;

a swing rod connected pivotally to said upstanding support and having a bottom section;

a slide rod having a rear end slidable forwardly and rearwardly along said rail assembly, and a front end connected pivotally to said crank member;

a pedal seat connected pivotally to said slide rod;

a pedal member mounted slidably on said pedal seat; and a link unit including a first link rod having a front end connected pivotally to said bottom section of said swing rod and a rear end connected pivotally to said pedal seat, and a second link rod having a front end connected pivotally to said bottom section of said swing rod below said front end of said first link rod and a rear end fixed to said pedal member.

2. The elliptical exercise apparatus of claim 1, wherein said pedal seat includes a pedal support connected pivotally to said slide rod, and a pedal rail fixed to said pedal support and having two opposite lateral sides formed respectively with slide grooves.

3. The elliptical exercise apparatus of claim 2, wherein said pedal member includes an inverted U-shaped slide plate having two opposite side plates, a pedal plate fixed on top of said slide plate, and a plurality of rollers mounted respectively on inner faces of said side plates and received slidably and correspondingly in said slide grooves.

4. The elliptical exercise apparatus of claim 1, wherein said swing rod further includes a grip section extending upwardly from said bottom section, and a pivot section between said grip section and said bottom section and connected pivotally to said upstanding support.

* * * * *